US005189855A

United States Patent [19]

Williams et al.

[11] Patent Number: 5,189,855

[45] Date of Patent: Mar. 2, 1993

[54] FOUNDATION RAFT FOR SUPPORTING A STRUCTURE

[75] Inventors: Antony A. B. Williams; Jean P. Pellissier; Brian G. Lunt, all of Pretoria, South Africa

[73] Assignee: CSIR, Pretoria, South Africa

[21] Appl. No.: 849,964

[22] Filed: Mar. 12, 1992

Related U.S. Application Data

[63] Continuation of Ser. No. 733,363, Jul. 19, 1991, abandoned, which is a continuation of Ser. No. 412,404, Sep. 26, 1989, abandoned.

[30] Foreign Application Priority Data

Sep. 30, 1988 [ZA] South Africa ..... 88/7366

[51] Int. Cl.[5] ..... E04B 1/86

[52] U.S. Cl. ..... 52/252; 52/337

[58] Field of Search ..... 52/303, 408, 480, 252

[56] References Cited

U.S. PATENT DOCUMENTS

| | | | |
|---|---|---|---|
| 4,295,415 | 10/1981 | Schneider, Jr. | 52/303 |
| 4,296,798 | 10/1981 | Schramm | 52/303 |
| 4,578,912 | 4/1986 | Ericsson | 52/303 |
| 4,888,927 | 12/1989 | Yoshimi et al. | 52/303 |

*Primary Examiner*—Richard E. Chilcot, Jr.
*Assistant Examiner*—Joanne C. Downs
*Attorney, Agent, or Firm*—Kuhn and Muller

[57] ABSTRACT

The invention provides a foundation raft for supporting a structure such as a low rise building on soil which is prone to heaving or settling. The raft has a pair of foundation slabs, of set cementitious material which are spaced apart by a plurality of upwardly extending webs. The webs are fast with the slabs. Each slab has a thickness A of 50–200 mm; the slabs are spaced apart by a spacing B of 100–1500 mm; and each web has a thickness C of 0.2–400 mm.

12 Claims, 3 Drawing Sheets

FOUNDATION RAFT FOR SUPPORTING A STRUCTURE

This application is a continuation application pursuant to 37 CFR 1.60 of application Ser. No. 07/733,363 filed Jul. 19, 1991, which application is a continuation of application Ser. No. 07,412,404 filed Sep. 26, 1989, both now abandoned, which application claims priority under application Ser. No. 88/7366 of the Republic of South Africa, filed Sep. 30, 1988.

THIS INVENTION relates to a foundation raft for a structure. More particularly, the invention relates to a foundation raft suitable for supporting a structure such as a low-rise building of up to about 3 floors in height, including the ground floor, a road, railway, airport runway or the like on a soil comprising an active clay which is prone to heaving or settling arising respectively from swelling or shrinkage thereof, or a sand which is prone to settling arising from consolidation.

According to the invention there is provided a foundation raft for a structure, the foundation raft comprising a pair of vertically spaced substantially horizontal foundation slabs of set cementitious material, the slabs being spaced apart by a plurality of upwardly extending spaced webs fast with the slabs, and the raft having a construction whereby:

each slab has a thickness in the range 50–200 mm;

the spacing between the slabs is in the range 100–1500 mm; and each web has a thickness in the range 0,2–400 mm.

The thickness of the spaced webs will depend on factors such as the mass of and spacing between the slabs, the spacing between the spaced webs, etc, but will principally be determined by the material from which the webs are made. It is contemplated that thin-walled [0,2–8 mm, preferably 1–4 mm] webs may be employed of e.g. steel or plastics materials; medium-walled [3–30 mm, preferably 5–25 mm] webs may be employed of e.g. wood, fibre-reinforced cementitious materials such as asbestos-cement, composite materials, hollow bricks or hollow blocks; or thick-walled [30–400 mm, preferably 50 -250 mm] webs may be employed of e.g. concrete, brickwork or blockwork, which may be reinforced or non-re-inforced.

The webs may be arranged so that they define a plurality of closed cells between the slabs.

Thus, for example, the webs may be arranged in a plurality of series, the webs of each series extending across the raft, and being spaced from one another. The webs of each series may be straight and parallel to one another, extending at an angle to the webs of each other series, the spacing between the webs of each series being 300–3500 mm. In a particular example there may be two series of webs, the webs of each series being normal to, and intersecting, the webs of the other series, to form a rectangular e.g. square, grid. In this case, the closed cellular spaces between the webs will be rectangular, and the horizontal spacing between the webs of a series may be 500–2500 mm, preferably 750–1800 mm, being optionally equally spaced from one another. Instead, three series of webs may be used, in a triangular or hexagonal layout.

Instead, the webs may define closed cells between the slabs by each being in the form of a hollow tubular unit having a central passage extending from the one slab to the other slab. Thus the webs may be hollow prisms or cylinders which extend vertically. A convenient shape is hollow-cylindrical, as short pipe lengths can be employed, in which case the pipe lengths may have a diameter in the range 100–2000 mm, preferably 300–800 mm. Preferably the prisms or cylinders are uniformly distributed between the slabs, e.g. by being arranged in rows, uniformly spaced in series, the rows being arranged in a rectangular or hexagonal grid.

Naturally, however, webs of other shapes and arrangements may be used, e.g. spaced panels which may be straight, flat and rectangular or may have vertically extending undulations or corners. These again should be more or less evenly distributed e.g. regularly spaced, between the slabs so that they provide the same degree of support for the upper slab and the same strength of interconnection between the slabs as described above for the pipe sections or grids of webs, although in this case there need be no closed cells.

Preferably the spacing between the slabs is 200–1000 mm, the slab thickness being 75–150 mm. While the webs will typically be vertical, they may, if desired, extend upwardly at an angle to both the horizontal and the vertical, e.g. when the webs are in the form of walls of a truncated pyramid or tetrahedron resting via its base on the lower slab.

In use the raft of the invention may be constructed; by casting the lower slab of settable cementitious material and arranging pre-cast spaced webs thereon in a desired layout, the lower edges of the webs penetrating the lower slab before it has set so that, after it has set, they are integral or fast therewith. In this case the edges of the precast webs may have a surface treatment or formation such as indentations or projections, to enhance keying and bonding to the slabs. The spaces between the webs may then be filled with sand or may have formers or shuttering placed thereon, to provide a surface on which the upper slab is cast, the upper edges of the webs projecting above this surface so that they are cast into and embedded in the upper slab. Instead, the webs may be cast in situ on the lower slab using suitable formwork or shuttering, to be fast with the lower slab, the formwork or shuttering being removed and the spaces between the webs being backfilled with sand or the like before the upper slab is cast. As indicated above, when the webs are of set cementitious material, they may have a thickness of 30–400 mm, and when the webs and/or slabs are of set cementitious material, the webs may be fast with the slabs by means of a cementitious bond therebetween. Alternatively the shuttering may be left in place, supporting the upper slab during casting, and forming voids in the completed raft. However, it is contemplated that brickwork webs, as described above, may often be used, e.g. by persons such as builders who are more familiar with brickwork than with cement casting.

The invention will now be described, by way of example, with reference to the accompanying diagrammatic drawings, in which.

Figure 1:
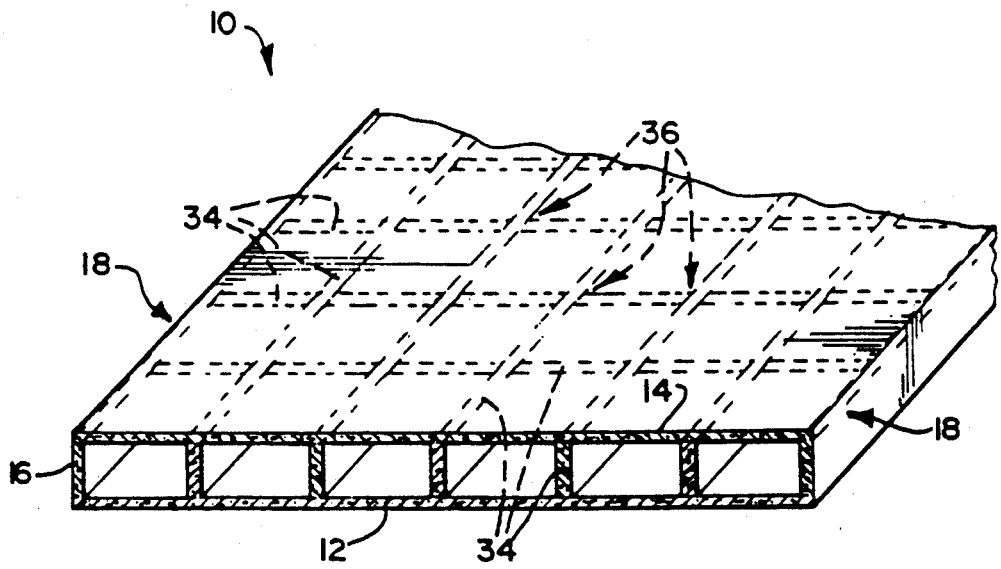
FIG. 1 shows a schematic sectional three dimensional view of part of a foundation raft in accordance with the invention, in the direction of line I—I in FIG. 3.

In FIGS. 1 to 6 of the drawings, reference numeral 10 generally designates a foundation raft in accordance with the present invention. The foundation raft comprises a pair of vertically spaced reinforced concrete slabs, namely a lower slab 12 and an upper slab 14, spaced apart by webs.

Figure 3:
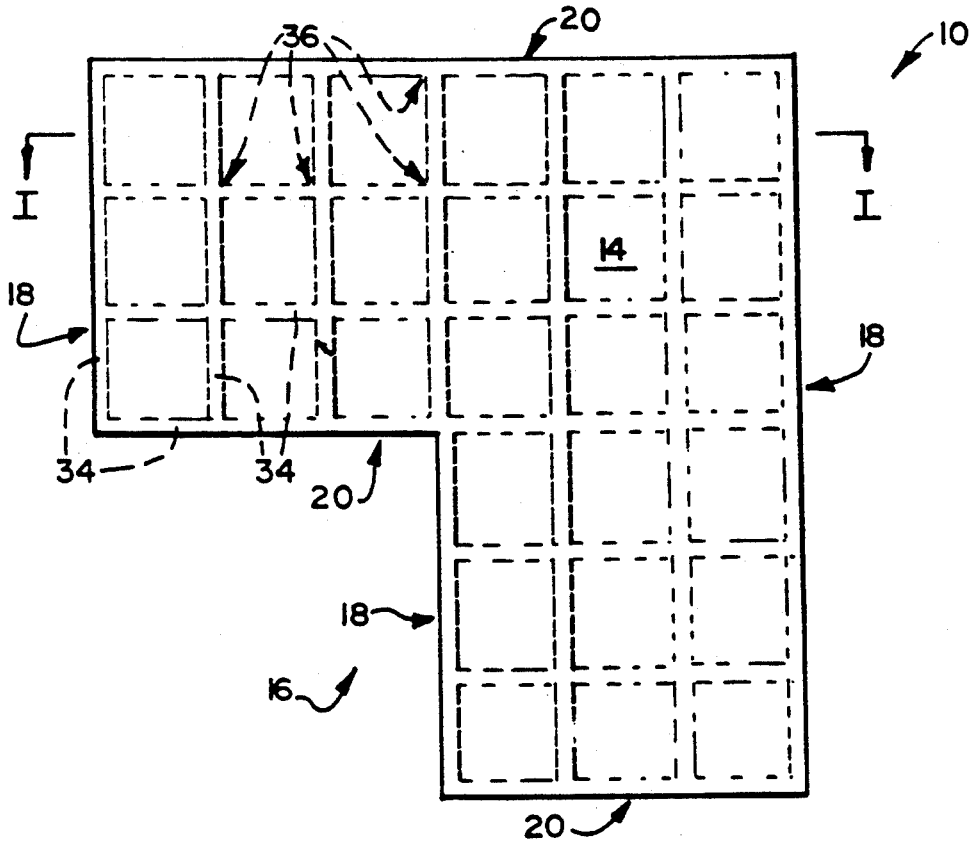
FIG. 3 shows a plan view of a possible layout for a raft of the type shown in FIGS. 1 and 2.

The slab 10 is essentially rectangular in plan view outline, although it may naturally have rectangular projections or indentations, e.g. as shown at 16 in FIG. 3. The outer periphery of the raft 10 accordingly has edges, e.g. as shown at 18 in FIG. 3, extending in one direction, and other edges, as shown at 20 extending in a direction normal to the edges 18.

Figure 2:
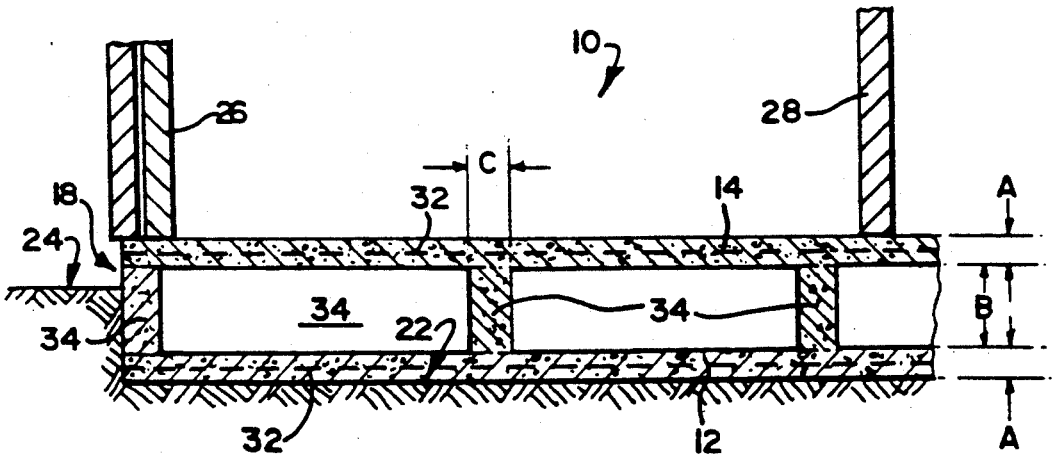
FIG. 2 shows a sectional elevation on an enlarged scale of part of the raft of FIG. 1 in use on the ground supporting walls of a building.

To make the raft 10 of FIGS. 1 to 6, a building site is cleared of vegetation and loose pockets of compressible material, and a smooth horizontal surface is then prepared with some degree of compaction, if necessary, to provide a firm working platform [see 22 in FIG. 2]. This working platform 22 may be below ground level as shown in FIG. 2. [In FIG. 2 the raft 10 is shown partly sunken into the ground 24, supporting an exterior wall 26 at one of its edges 18 supporting an interior wall 28 at a position remote from its edges 18, 20].

Figure 6:
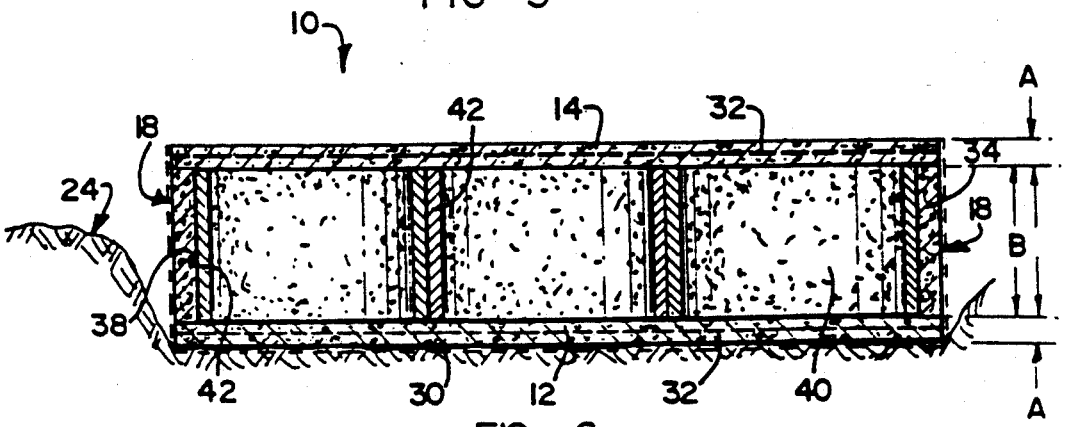
FIG. 6 shows a sectional elevation on an enlarged scale of the raft of FIG. 5, in the direction of line VI—VI in FIG. 5.

The layout or plan view outline of the foundation raft 10 is marked on the surface 22 and the lower slab 12 is then cast in situ thereon from cementitious material such as concrete, typically on a damp proof membrane such as plastics sheeting [see 30 in FIG. 6] to reduce water loss, steel reinforcement in the form of mesh, or bar reinforcement being located in position in the slab 12 as shown at 32.

The spacer webs are introduced either before or after casting of slab 12, depending on the particular technique used to create the webs, as described below. The space between the two slabs 12 and 14 may contain voids or be filled. Finally, the upper slab 14 is cast and allowed to cure.

The walls 26, 28 may then be built in position as shown in FIG. 2. The top surface of the upper slab will typically be floated to provide it with a smooth finish before construction of the walls and other superstructure takes place.

In FIGS. 1 to 3 the slabs 12 and 14 are shown interconnected by two series of spacer webs 34. One series of webs 34 extends in a direction parallel to the edges 18, the other series of webs extending in a direction normal to the first series, and parallel to the edges 20.

The webs 34 of each series are evenly spaced in series from one another, the webs 34 of the one series intersecting the webs 34 of the other series at corners as at 35. The webs 34 are arranged so that the web 34 at the end of each series is at the periphery [is, 20] of the raft 10, and so that the edges of the upper slab 14 are supported.

In FIGS. 1 to 3, the webs 34 may be cast in situ on the lower slab 12 before it has finally set, to be integral therewith, suitable formwork or shuttering being provided on the slab 12 for this purpose; or the webs 34 may be in the form of precast panels which are laid in position on the slab 12 before it has set so that their lower edges can be worked into the green material of the panel 12 to be integral therewith after the panel 12 has set. Instead, the webs 34 may be located and held in position before panel 12 is cast.

After a suitable period to allow the green concrete to harden, the spaces between the webs 34 may be filled with sand or soil, or with cardboard formers, suitable shuttering boxes or the like, to present an upwardly facing surface for the casting of the upper slab 14. The upper edges of the webs 34 may project above this surface, and the upper slab 14 will be cast on this upper surface in a similar fashion to the casting of the lower slab 12, with mesh or bar reinforcing 32, so that the upper edges of the webs 34 become integral with [and incorporated by] the upper slab 14.

Figure 4:
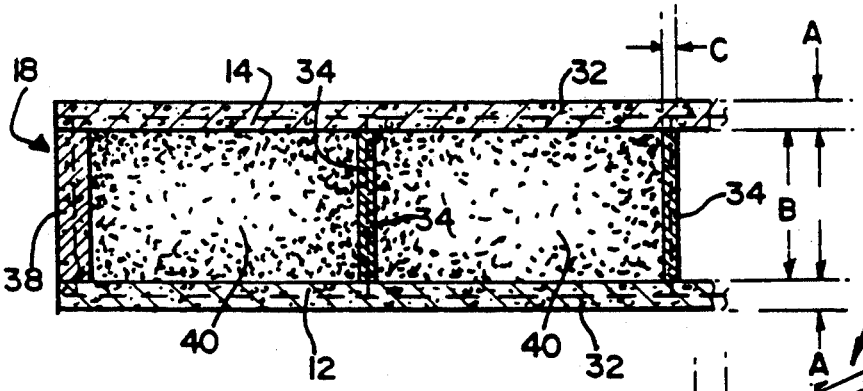
FIG. 4 shows a sectional elevation on an enlarged scale of part of another foundation raft in accordance with the invention.
Figure 4A:
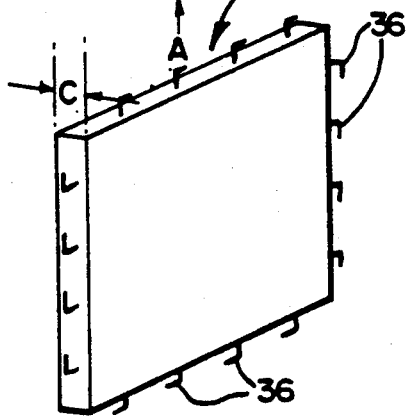
FIG. 4A shows a three dimensional view of a web forming part of the raft of FIG. 4.

Turning to FIGS. 4 and 4A, an embodiment is shown of the raft 10, employing precast panels as webs 34. In FIG. 4 the same reference numerals refer generally to the same parts as in FIGS. 1-3, unless otherwise specified. One of the precast panels 14 is shown in FIG. 4A. These panels 16 have bent steel anchors embedded therein, and projecting from their edges as shown at 36 in FIG. 4A. Naturally, castellations can be employed instead of or in addition to the bent steel anchors.

With reference to FIG. 4, after the lower slab 12 has been cast, the webs at the peripheral edges of the raft, which peripheral webs are designated 38, will be cast in situ. The webs 34 will be placed in position on the slab 12 while it is green, so that the anchors 36 at the lower edges of the webs 34 penetrate into and are embedded in the slab 12, e.g. so that they engage the mesh 32. Where webs 34 intersect the peripheral webs 38, the steel anchors 36 on the side edge of each web 34 which intersects a peripheral web 38 may similarly be embedded in the peripheral web 38 while it is green. Where several webs 34 intersect at a corner, the space therebetween, which will contain the anchors 36 of said webs 34, may be filled with a pillar of concrete which is allowed to set there.

The upper slab 14 will then finally be cast in a fashion similar to that described above for FIGS. 1 to 3. In FIG. 4 compacted soil filling is shown at 40, but this space between the webs may instead be filled, as mentioned above, by cardboard formers, shuttering boxes or the like which are left permanently in place.

Figure 5A:
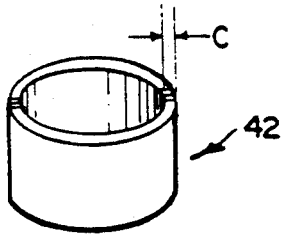
FIG. 5A shows a three dimensional view of one of the webs of the raft of FIG. 5.
Figure 5:
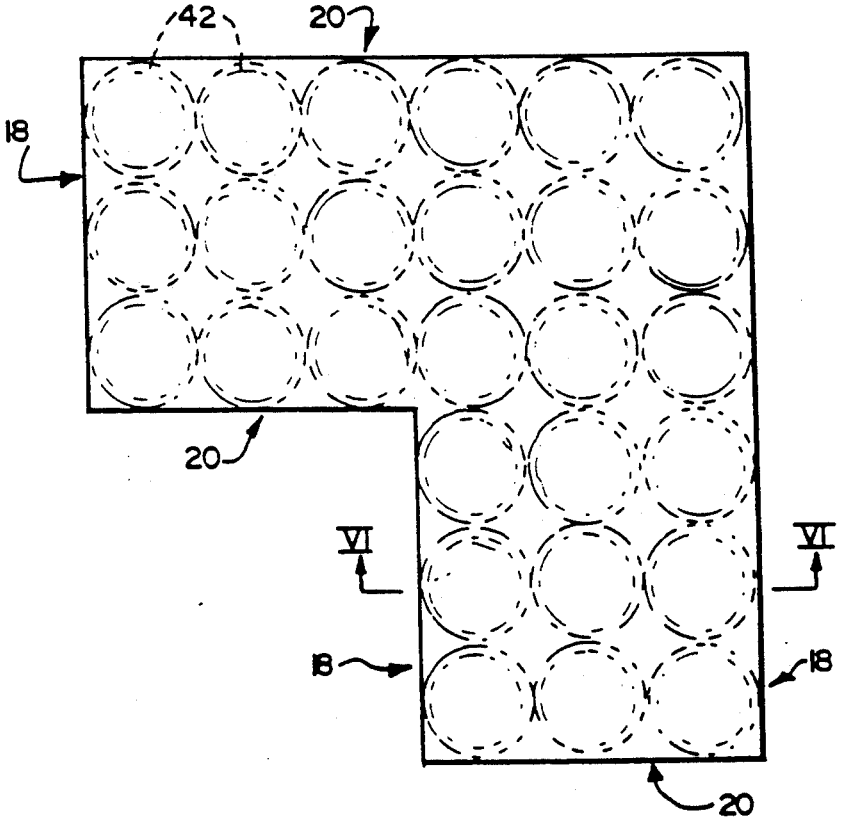
FIG. 5 shows a view similar to FIG. 3 of yet another raft in accordance with the invention.

Turning to FIGS. 5 and 6, another raft is again generally designated 10, and once again the same reference numerals are used for the same parts, unless otherwise specified. In this case the webs are designated 42, and are in the form of short or truncated pipe lengths, one of which is shown in FIG. 5A. The pipe lengths 42 are shown between the slabs 12, 14 in square close packed rectangular grid relationship, abutting one another side-by-side. The raft 10 is shown with flat peripheral webs 38 of the type described above with reference to FIG. 4, and steel mesh or bar reinforcing is again shown at 32 in the slabs 12, 14, together with a suitable damp proof plastics membrane at 30 for waterproofing below the lower slab 12.

The closed cellular spaces in the pipes 42 and in the spaces defined between the pipes 42, are filled with compacted soil.

To make the raft 10 shown in FIGS. 5 to 6, the slab 12 and peripheral webs 38 are cast in a fashion similar to that described above with reference to FIG. 4, and the pipe webs 42 are placed in position as shown in FIG. 5 with their lower edges embedded in the green material of the slab 12 before it has set. The sand 40 is then compacted in position, leaving the upper edges of the peripheral webs 38 and of the pipe webs 42 standing proud from the upper surface of the sand, on which upper surface the slab 14 is then cast, so that said upper edges are embedded therein.

In the drawings, the slabs 12, 14 have a thickness of about 100–150 mm as shown by A; the spacing between the slabs is about 500–1000 mm as shown by B; and the web thickness, as shown by C is about 50–250 mm.

It is an advantage of the raft of the present invention that the provision of the spaced slabs 12, 14, interconnected by the webs 34, 38, 42 provides the raft with desirable torsional stiffness to permit superstructures to be built thereon which can omit articulation joints in simple layouts, or which have a relatively low number of articulation joints in more complex buildings.

The positions of the webs 34, 38 can be selected, within limits, to provide the best or at least adequate support for the positioning of walls at preselected positions on the raft 10. In embodiments which employ precast webs, these can be made under factory conditions with enhanced quality control relative to in situ casting. Concrete casting is further simplified, as this, particularly with the precast webs, can be limited to the casting of the slabs 12, 14.

Although L-shaped and rectangular raft outlines have been shown in the drawings, rafts can in principle be made of more complex outlines, particularly rectangular outlines, with relatively little difficulty.

A particular advantage of the raft of the present invention is that no trenching in soil is required, together with the attendant disadvantages arising from caving-in of sandy soils into trenches. Some earth moving may however be required to provide a flat surface for the lower slab.

In addition to being suitable as a foundation raft for heaving clays, the rafts of the present invention can also be useful where buildings are to be built on so-called collapsing sands where differential settlement can occur, as on ground or soil supports which are variable as encountered on land fills, e.g. at back-filled quarries, rubbish dumps or waste heaps. Similarly, in dolomitic areas, variability and settlement can be encountered, and the rafts of the present invention show promise for these situations.

Further, where large ground strains may occur at the surface due to the subsidence caused by undermining, the flat bottom is an advantage in providing a plane shear surface compared with the downward projection of footings or beams in other types of foundation.

While the invention with reference to the drawings has been described with particular reference to a foundation raft for a low rise building, it will be appreciated that such foundation rafts can have substantially the same utility in other situations where similar soil problems are encountered, e.g. when the rafts are used to support structures in the form of the pavement of roads, in the form of railways, in the form of airport or airfield runways, in the form of bridge ramps, etc.

We claim:

1. A foundation raft comprising a pair of vertically spaced substantially horizontal foundation slabs of set cementitious material, namely an upper slab and a lower slab having a space therebetween, the slabs being spaced apart by a plurality of upwardly extending webs, for supporting a low-rise walled building of at most three floors in height on underlying material which is prone to heaving or differential settling which subjects the raft to slowly varying vertical forces on its lower source, with the walls of the building, at least in part, resting on parts of the upper slab which have no web thereunder, the lower slab having a lower surface for resting directly on said underlying material, each said slab being continuous and integral and having a periphery which has an outline in plan view which is the same as that of the raft as a whole, and being horizontally reinforced in different directions by substantially horizontally extending reinforcement which is embedded therein, which reinforcement extends substantially continuously across the full area of said slab, a plurality of said webs being substantially evenly distributed relative to one another in the space between the slabs and extending, at least in part, in different horizontal directions, those webs spaced inwardly from the periphery of the raft all being substantially the same thickness and being integrally bonded to each of the slabs, a plurality of said webs being arranged along the periphery of the raft so that they surround at least a portion of the space between the slabs located inwardly of said periphery, the raft having a construction whereby:

each slab has a thickness in the range of 50–200 mm;

the spacing between the slabs is in the range 100–1500 mm; and each web has a thickness in the range 0.2–400 mm; and adjacent webs are spaced apart by 300–3500 mm.

2. A raft as claimed in claim 1, in which the webs are arranged so that they define a plurality of closed cells between the slabs.

3. A raft as claimed in claim 1, in which the webs are arranged in a plurality of series, the webs of each series extending alongside one another across the raft and being spaced from one another.

4. A raft as claimed in claim 3, in which the webs of each series are equally spaced from one another.

5. A raft as claimed in claim 3, in which the webs of each series are straight and parallel to each other, and are not parallel to the webs of any of the other series of webs, the spacing of the webs of each series being at least 300 mm.

6. A raft as claimed in claim 5, in which there are two said series of webs, namely a first series, the webs of which are straight and parallel to one another and a second series, the webs of the first series being normal to, and intersecting, the webs of the second series, to form a rectangular grid.

7. A raft as claimed in claim 1, in which the webs are of set cementitious material and have a thickness in the range 30–400 mm.

8. A raft as claimed in claim 7, in which the webs are bonded to the slab by means of a cementitious bond therebetween.

9. A raft as claimed in claim 1, in which the webs are free of any horizontally extending metal reinforcement, being formed of a material selected from the group consisting of set cementitious material/concrete, brickwork and blockwork.

10. A raft as claimed in claim 9, in which a plurality of the webs are in the form of precast webs having upper and lower edges embedded respectively in the upper and lower slabs.

11. A foundation raft for supporting a structure on underlying material, the foundation raft comprising a pair of vertically spaced substantially horizontal foundation slabs of set cementitious material, namely an upper slab and a lower slab, the lower slab having a lower surface for resting on said underlying material and the slabs being spaced apart by a plurality of upwardly extending webs located between the slabs and connected to the slabs by means of an integral bond therebetween, each web being in the form of a hollow tubular unit having a central passage extending from the one slab to the other slab and having upper and lower edges embedded respectively in the upper slab and the lower slab, and the raft having a construction whereby:

each slab has a thickness in the range of 50–200 mm;

the spacing between the slabs is in the range 100–1500 mm; and each web has a thickness in the range 0.2–400 mm.

12. A low-rise walled building of at most three floors in height, the building having a foundation whereby it is supported on underlying material which is prone to heaving or differential settling, which subject the raft to slowly varying vertical forces on its lower surface, the foundation being in the form of a foundation raft comprising a pair of vertically spaced substantially horizontal foundation slabs of set cementitious material, namely an upper slab and a lower slab having a space therebetween, the slabs being spaced apart by upwardly extending webs and the walls of the building, at least in part, resting on parts of the upper slab which have no web thereunder, the lower slab having a lower surface resting directly on said underlying material, each said slab being continuous and integral and having a periphery which has an outline in plan view which is the same as that of the raft as a whole, and being horizontally reinforced in different directions by substantially horizontally extending reinforcement which is embedded therein, which reinforcement extends substantially continuously across the full area of said slab, a plurality of said webs being substantially evenly distributed relative to one another in the space between the slabs and extending, at least in part, in different horizontal directions, those webs spaced inwardly from the periphery of the raft all being of substantially the same thickness and being integrally bonded to each of the slabs, a plurality of said webs being arranged along the periphery of the raft so that they surround at least a portion of the space between the slabs located inwardly of said periphery, the raft having a construction whereby:

each slab has a thickness in the range of 50–200 mm;

the spacing between the slabs is in the range 100–1500 mm; and each web has a thickness in the range 0.2–400 mm; and adjacent webs are spaced apart by 300–3500 mm.

* * * * *

UNITED STATES PATENT AND TRADEMARK OFFICE

CERTIFICATE OF CORRECTION

PATENT NO. : 5,189,855

DATED : March 2, 1993

INVENTOR(S) : Antony A. B. Williams; Jean P. Pellissier; Brian G. Lunt

It is certified that error appears in the above—identified patent and that said Letters Patent is hereby corrected as shown below:

In the Drawings:
Reference numeral "36" in Figure 1 should in fact be --35--.

In column 3 at line 16 the expression "slab 10" should be replaced by --raft 10--.

Signed and Sealed this

Fifteenth Day of March, 1994

*Attest:*

*Attesting Officer*

BRUCE LEHMAN

*Commissioner of Patents and Trademarks*

UNITED STATES PATENT AND TRADEMARK OFFICE

CERTIFICATE OF CORRECTION

PATENT NO. : 5,189,855

DATED : March 2, 1993

INVENTOR(S) : Antony A. B. Williams, Jean P. Pellissier, Brian G. Lunt

It is certified that error appears in the above—identified patent and that said Letters Patent is hereby corrected as shown below:

In the Drawings: Reference numeral "36" in Figure 3 should be -- 35 --.

Signed and Sealed this

Twenty-second Day of November, 1994

*Attest:*

Bruce Lehman

BRUCE LEHMAN

*Attesting Officer*

*Commissioner of Patents and Trademarks*